US011048188B2

(12) United States Patent
Fujioka et al.

(10) Patent No.: US 11,048,188 B2
(45) Date of Patent: Jun. 29, 2021

(54) DEVELOPING DEVICE HAVING LIQUID DEVELOPER MOVEMENT RESTRICTION

(71) Applicant: CANON KABUSHIKI KAISHA, Tokyo (JP)

(72) Inventors: Ryota Fujioka, Kashiwa (JP); Teppei Nagata, Abiko (JP); Takehiro Kojima, Tokyo (JP); Shota Takami, Kamagaya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/581,991

(22) Filed: Sep. 25, 2019

(65) Prior Publication Data

US 2020/0019087 A1 Jan. 16, 2020

Related U.S. Application Data

(63) Continuation of application No. PCT/JP2018/014346, filed on Mar. 28, 2018.

(30) Foreign Application Priority Data

Mar. 28, 2017 (JP) ..... JP2017-063729

(51) Int. Cl.
*G03G 15/08* (2006.01)
*G03G 21/00* (2006.01)

(52) U.S. Cl.
CPC ..... *G03G 15/0812* (2013.01); *G03G 15/0808* (2013.01); *G03G 21/0029* (2013.01)

(58) Field of Classification Search
CPC ..... G03G 15/0812; G03G 15/0808; G03G 15/10; G03G 15/101; G03G 15/104; G03G 21/0029
See application file for complete search history.

(56) References Cited

U.S. PATENT DOCUMENTS 4,399,933 A * 8/1983 Anderson ..... G03G 15/0822 222/228
2009/0238607 A1* 9/2009 Miyazawa ..... G03G 15/104 399/238

(Continued)

FOREIGN PATENT DOCUMENTS

JP 51-6733 A 1/1976
JP 2001-349442 A 12/2001

(Continued)

OTHER PUBLICATIONS

Shohta Takami et al., U.S. Appl. No. 16/707,443, filed Dec. 9, 2019.

(Continued)

*Primary Examiner* — Joseph S Wong
(74) *Attorney, Agent, or Firm* — Venable LLP

(57) ABSTRACT

A developing device includes a rotatable developer carrying member carrying a liquid developer on a carrying surface for developing an electrostatic latent image borne on an image bearing member, and an end portion restricting member, provided in contact with the developer carrying member at an end portion of the developer carrying member with respect its rotational axis direction, for restricting movement of the liquid developer in the rotational axis direction of the developer carrying member. A contact angle of the liquid developer to a side surface of the end portion restricting member on a side where the developer carrying member carries the liquid developer is larger than a contact angle of the liquid developer to the carrying surface of the developer carrying member, and the contact angle of the liquid developer to the side surface of the end portion restricting member is 45° or more.

7 Claims, 7 Drawing Sheets

(56) References Cited

U.S. PATENT DOCUMENTS

| | | | |
|---|---|---|---|
| 2010/0098470 | A1 | 4/2010 | Chiba et al. |
| 2016/0349668 | A1 | 12/2016 | Pingel et al. |

FOREIGN PATENT DOCUMENTS

| | | | |
|---|---|---|---|
| JP | 2005-242239 | A | 9/2005 |
| JP | 2006-085159 | A | 3/2006 |
| JP | 2009-116032 | A | 5/2009 |
| JP | 2010-217689 | A | 9/2010 |
| JP | 2011-022246 | A | 2/2011 |
| JP | 2016-224191 | A | 12/2016 |
| JP | 2016-224408 | A | 12/2016 |

OTHER PUBLICATIONS

PCT International Search Report and Written Opinion dated Jul. 3, 2018, in PCT/JP2018/014346.
European Search Report dated Feb. 24, 2021, in related European Patent Application No. 18775000.5.

* cited by examiner

DEVELOPING DEVICE HAVING LIQUID DEVELOPER MOVEMENT RESTRICTION

This application is a continuation of PCT Application No. PCT/JP2018/014346, filed on Mar. 28, 2018.

TECHNICAL FIELD

The present invention relates to a developing device used in an image forming apparatus.

BACKGROUND ART

Conventionally, as the developing device used in the image forming apparatus of an electrophotographic type or the like, a constitution of a so-called liquid development type (wet development type) in which a liquid developer in which toner particles are dispersed in a carrier liquid is used has been known. In the developing device of the liquid development type, the liquid developer is carried on a developer carrying member such as a developing roller and the developer carrying member is rotated, and the toner particles are subjected to electrophoresis in a nip formed between the developing device and an image bearing member bearing an electrostatic latent image, whereby the electrostatic latent image is developed into a toner image.

In Japanese Laid-Open Patent Application 2011-22246, a constitution in which in a developing device of the liquid development type, a cleaning blade for cleaning a member-to-be-cleaned such as the developing roller and a heat source such as a halogen lamp for heating the member-to-be-cleaned in a region outside the cleaning blade are provided is described. In this constitution, a carrier liquid passing through the region outside the cleaning blade is heated and vaporized, so that the carrier liquid is prevented from causing liquid leakage or the like by moving around an end portion of the member-to-be-cleaned.

In this constitution, the heat source or the like is newly needed, and therefore this constitution is a constitution in which the number of component parts increases.

SUMMARY OF THE INVENTION

Problem to be Solved by the Invention

Therefore, the present invention aims at providing a developing device capable of reducing movement of a developing liquid around an end portion by a simple constitution.

Means for Solving the Problem

According to an aspect of the present invention, there is provided a developing device comprising: a rotatable developer carrying member for carrying a liquid developer for developing an electrostatic latent image borne on an image bearing member; and an end portion restricting member, provided in contact with the developer carrying member at an end portion of the developer carrying member with respect to a rotational axis direction of the developer carrying member, for restricting movement of the liquid developer in the rotational axis direction, wherein a contact angle of a side surface of the end portion restricting member, on a side where the developer carrying member carries the liquid developer, to the liquid developer is 45° or more.

Effect of the Invention

According to the developing device in accordance with the present invention, it is possible to reduce the movement of the developing liquid around the end portion by the simple constitution.

EMBODIMENTS FOR CARRYING OUT THE INVENTION

First Embodiment

Figure 1:
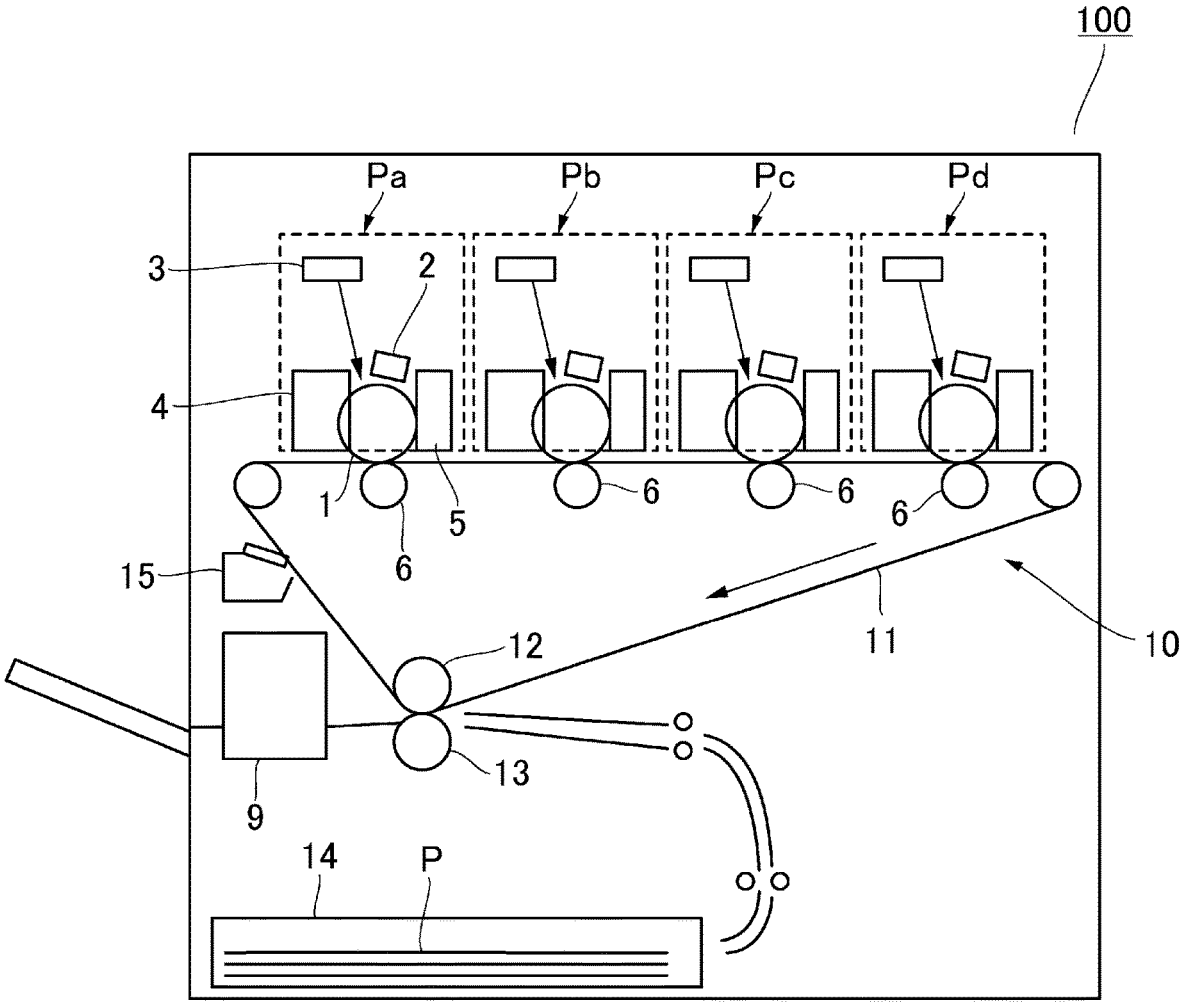
FIG. 1 is a schematic view showing a structure of an image forming apparatus according to the present disclosure.

In the following, an image forming apparatus according to the present disclosure will be described while making reference to the drawings. An image forming apparatus 100 according to this embodiment includes, as shown in FIG. 1, an image forming engine 10 of a so-called intermediary tandem type in which four image forming stations Pa, Pb, Pc and Pd and an intermediary transfer belt 11 are provided inside an apparatus main assembly. The image forming apparatus 100 forms and outputs an image on a recording material P on the basis of image information read from an original or image information inputted from an external device. Incidentally, the recording material P includes, in addition to plain paper, special paper such as coated paper, paper having a special shape such as an envelope or index paper, a plastic film for an overhead projector, and a cloth, and the like.

The image forming stations Pa-Pd which are image forming units of an electrophotographic type includes photosensitive drums 1 as image bearing members, respectively, and form toner images of yellow, magenta, cyan and black on surfaces of the photosensitive drums 1 on the basis of image information. Structures of the respective image forming stations are substantially the same, and therefore, a unit structure will be described by taking the yellow image forming station Pa as an example.

Figure 2:
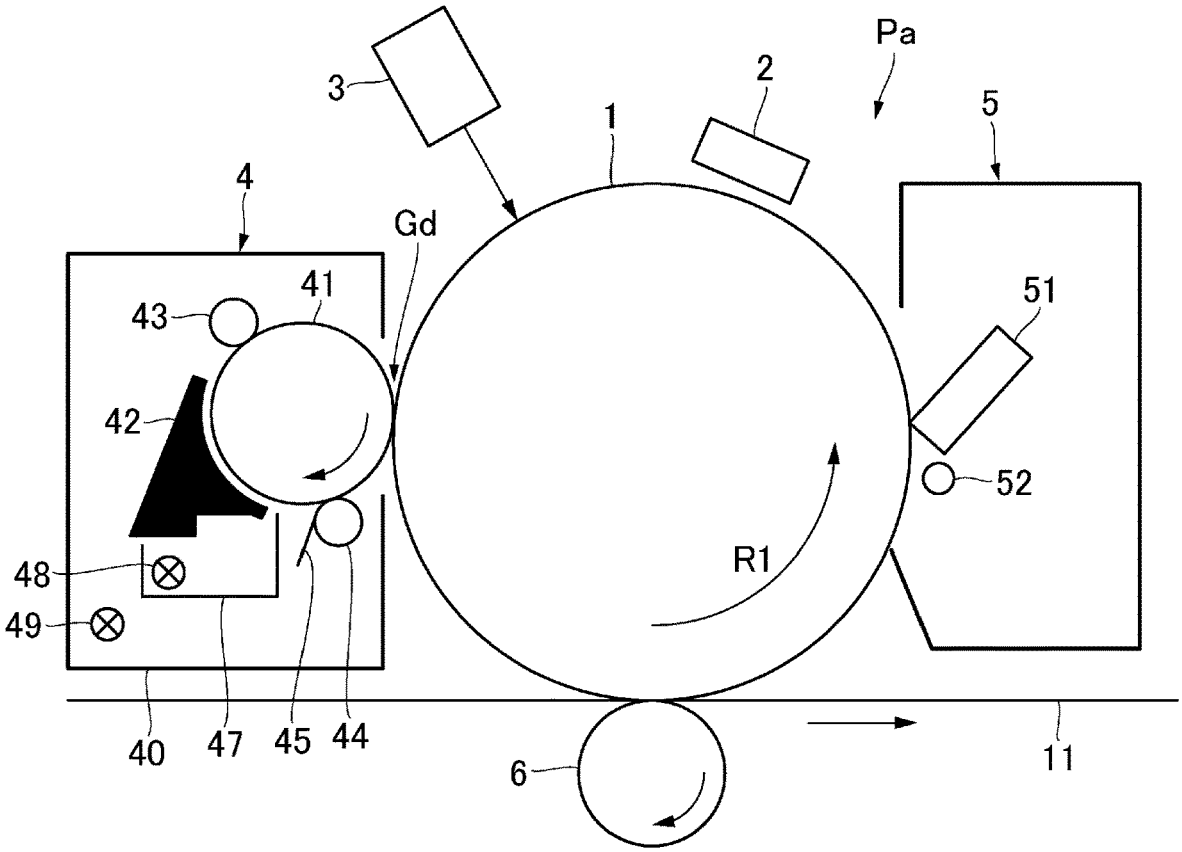
FIG. 2 is a schematic view showing a structure of an image forming station.

As shown in FIG. 2, the image forming station Pa includes the photosensitive drum 1, a charging device 2, an exposure device 3, a developing device 4, a cleaning device 5, a developing liquid supplying and circulating device (not shown), and a primary transfer roller 6. The photosensitive drum 1 is a drum-shaped photosensitive member, and is rotationally driven in a predetermined direction (arrow R1) in which the photosensitive drum 1 is taken and rotated by the intermediary transfer belt 11.

The charging device 2 electrically charges the surface of the photosensitive drum 1 uniformly by proximity discharge or corona discharge under application of a bias voltage from a high-voltage substrate mounted in the image forming apparatus. The exposure device 3 irradiates the charged surface of the photosensitive drum 1 with light based on the image information and exposes the photosensitive drum surface to the liquid, so that an electrostatic latent image is formed on the drum surface. The exposure device 3 includes a light source device and a polygonal mirror, and laser light emitted from the light source device is subjected to scanning by rotating the polygonal mirror, and a light flux of scanning light thereof is deflected by a plurality of reflection mirrors and concentrated on generatrix of the photosensitive drum 1 by an fθ lens, and thus performs exposure of the drum surface to light.

The developing device 4 includes a developing roller 41 as a developer carrying member, and develops the electrostatic latent image in a developing portion Gd formed between the developing roller 41 and the photosensitive drum 1. The developing device 4 in this embodiment is of a so-called liquid development type (wet development type) in which a liquid developer in which toner particles are dispersed in a carrier liquid is used, and the developing roller 41 rotates in a state in which the developing roller 41 carries the liquid developer on an outer peripheral surface. The developing device 4 supplies the toner particles to the photosensitive drum 1 by applying a bias voltage to the developing roller 41 and visualizes the electrostatic latent image into a toner image. Incidentally, a detailed structure of the developing device 4 will be described later.

The toner image carried on the surface of the photosensitive drum 1 is primary-transferred onto the intermediary transfer belt 11 by the primary transfer roller 6 as a transfer device. The primary transfer roller 6 rotates in a direction, in which the primary transfer roller 6 is taken and rotated by the intermediary transfer belt 11, in a state in which the primary transfer roller 6 contacts an inner peripheral surface of the intermediary transfer belt 11, and to which a bias voltage opposite in polarity to a charge polarity of the toner particles, whereby the toner particles are subjected to electrophoresis toward the intermediary transfer belt 11. At this time, the toner images formed by the respective image forming stations Pa-Pd are multi-transferred so as to be superposed on each other, so that a full-color toner image is formed on the surface of the intermediary transfer belt 11. A deposited matter such as primary transfer residual toner remaining on the photosensitive drum 1 without being transferred on the intermediary transfer belt 11 is collected by the cleaning device 5. The cleaning device 5 includes a cleaning blade for scraping off the deposited matter together with the carrier liquid from the photosensitive drum and includes a pipe 52 for collecting the liquid developer scraped off.

As shown in FIG. 1, the intermediary transfer belt 11 as an intermediary transfer member is wound around the four primary transfer rollers 6, a secondary transfer inner roller 12, a driving roller, a tension roller and the like, and rotates in a predetermined direction (clockwise direction in the figure) along a feeding direction of the recording material P. On an outer periphery side of the intermediary transfer belt 11, as a secondary transfer device, a secondary transfer roller 13 opposing the secondary transfer inner roller 12 is provided. The toner images transferred on the intermediary transfer belt 11 by the above-described image forming stations Pa-Pd are secondary-transferred onto the recording material P by a bias voltage applied to the secondary transfer roller 13. Incidentally, the recording material P is accommodated in a feeding cassette 14 and is fed toward the secondary transfer roller 13 with progress of toner image formation by the image forming stations Pa-Pd. Further, a deposited matter such as secondary transfer residual toner remaining on the intermediary transfer belt 11 without being transferred onto the recording material P is collected by a cleaning device 15. The recording material P on which the toner image is transferred is conveyed to a fixing portion 9 and is subjected to a predetermined fixing process of a heat fixing type or a photo-curing type or the like by the fixing portion 9, and thereafter is discharged to an outside of the apparatus.

Here, as the photosensitive drum 1, one in which a photosensitive layer of an amorphous silicon type is provided on a rigid base layer member such as aluminum and preferably thereon, a protective layer comprising a silicone-based resin material is formed is used. The photosensitive drum 1 in this embodiment is used in a state in which the photosensitive drum 1 is charged to the negative polarity and for example, a surface potential (dark-portion potential) after the photosensitive drum 1 is charged by the charging device 2 is set at −600 [V], and a surface potential (light-portion potential) after the photosensitive drum 1 is exposed to light by the exposure device 3 is set at −200 [V]. Entirety of the photosensitive drum 1 is constituted in an outer diameter of 100 mm, and is rotationally driven about a center line of a cylindrical shape as a rotational axis in an arrow R1 direction at a process speed (peripheral speed) of 500 mm/sec by a driving force supplied from a driving source such as a motor. Further, as regards productivity, the image forming apparatus is capable of performing a sheet passing of 100 sheets per minute in terms of A4(-size) sheets. Incidentally, the cylinder made of aluminum which is an inner periphery portion of the photosensitive drum is grounded.

Further, in a structural example of this embodiment, the bias voltage applied to the primary transfer roller 6 is +400 [V], and an outer diameter of a primary transfer roller 6 is 20 mm. The primary transfer roller 6 has a structure in which an outer periphery portion of a core shaft of stainless steel is covered with an elastic member such as a rubber, for example. A cleaning blade 51 is bonded at a part thereof to a metal plate, and the metal plate is fixed to a frame of the image forming station Pa by a rail-shaped member (not shown) and is press-contacted to the photosensitive drum 1. Further, the cleaning blade 51 has a certain size with respect to a longitudinal direction (axial direction of the photosensitive drum 1) and is 2.0 mm in thickness and 10 mm in free length which is a length from a portion covered with the metal plate portion to a free end.

[Developing Device]

Next, a structure of the developing device 4 will be described using FIG. 2. The developing device 4 includes the developing roller 41, a developing container 40, a supply tray 47, an electrode member 42, a squeeze roller 43, a cleaning roller 44 and a cleaning blade 45. To the developing container 40 accommodating the liquid developer (hereinafter, referred to as a "developing liquid"), a supply pipe 48 which is an inlet path of the developing liquid and a collection pipe 49 which is an outlet path of the develop are connected. The supply pipe 48 and the collecting pipe 49 are connected to an unshown mixer for temporarily store the developing liquid. In the mixer, the developing liquid collected from the collection pipe 49 and the toner and the carrier which are to be newly replenished are stirred and thus are uniformly mixed, so that the developing liquid in a state in which the developing liquid is adjusted to a proper concentration is supplied to the developing container 40 via the supply pipe 48.

The developing liquid discharged from the supply pipe 48 is stored in the supply tray 47 inside the developing container 40. The supply tray 47 as a supply portion supplies the developing liquid to an outer peripheral surface of the developing roller 41 with rotation of the developing roller 41. When the developing liquid carried on the predetermined 41 enters a gap between the developing roller 41 and the electrode member 42, the toner is electrophoretically moved toward the developing roller 41 by a bias voltage of the negative polarity applied to the electrode member 42. By this, a layer in which the toner is concentrated is in the neighborhood of the outer peripheral surface of the developing roller 41.

In the structural example of this embodiment, the bias voltage applied to the developing roller 41 is set at −400 [V], and the bias voltage applied to the electrode member 42 is set at −1000 [V]. Further, the developing device is constituted so that a gap between the developing roller 41 and the electrode is 500 μm, an outer diameter of the developing roller is 50 mm, and a section in which the developing roller 41 and the electrode member 42 oppose each other corresponds to an angle of rotation of 70° with respect to a rotational axis of the developing roller 41.

The squeeze roller 43 is disposed downstream of the electrode member 42 and upstream of the developing portion Gd with respect to the rotational direction of the developing roller 41, and regulates a liquid amount of the developing liquid reaching the developing portion Gd. The squeeze roller 43 is rotational driven in a state in which the squeeze roller 43 is contacted to the developing roller 41 with a certain pressure. Further, also to the squeeze roller 43, the bias voltage is applied, so that the toner particles are further pushed toward the developing roller 41 by an electric field generating in a nip between the squeeze roller 43 and the developing roller 41. By this, when the developing liquid passes between the developing roller 41 and the squeeze roller 43, the toner in the developing liquid is further pushed toward the developing roller side, so that a developing liquid layer having a high density (concentration) and a uniform height is formed on the surface of the developing roller 41. On the other hand, an excessive carrier liquid removed from the toner by the squeeze roller 43 passes through an upper surface of the electrode member 42 and drops on a bottom of the developing container 40, and is collected to the mixer through the collection pipe 49. In the structural example of this embodiment, the bias applied to the squeeze roller 43 is −400 [V], and an outer diameter of the squeeze roller 43 is set at 15 mm. The squeeze roller 43 is an example of a liquid amount regulating member, and for example, a blade-like liquid amount regulating member may also be used.

When the developing liquid carried on the developing roller 41 reaches the developing portion Gd, by the bias voltage applied to the developing roller 41, the toner particles electrophoretically moves toward the photosensitive drum 1. At this time, mobility of the toner particles is determined depending on the surface potential of the photosensitive drum 1, so that the toner particles are deposited on a region of the photosensitive drum 1 in which the electrostatic latent image is formed. By this, the electrostatic latent image is visualized as the toner image. Further, when the surface of the photosensitive drum 1 passes through the developing portion Gd and separates from the developing roller 41, a part of the carrier liquid moves to the photosensitive drum 1, so that a state in which the surface of the photosensitive drum 1 is covered with the carrier liquid is formed.

The developing liquid which did not move to the photosensitive drum 1 reaches the cleaning roller 44 positioned downstream the developing portion Gd with respect to the rotational direction of the developing roller 41. The cleaning roller 44 rotates in a state in which the cleaning roller 44 contacts the developing roller 41 with a certain contact pressure. Also to the cleaning roller 44, the bias voltage is applied, and the toner particles remaining on the surface of the developing roller 41 are pulled out of the developing roller 41, and is electrically attracted to the cleaning roller 44. The developing liquid moved to the cleaning roller 44 is further pulled off of the cleaning roller 44 by the cleaning blade 45 and drops on the bottom of the developing container 40, and is collected to the mixer through the collection pipe 49. In the structural example of this embodiment, to the cleaning roller 44, the bias voltage such that a potential on the basis of the developing roller 41 is +200 [V] is applied. Further, the cleaning blade 45 is constituted so as to have the same potential as the cleaning roller 44.

Further, in the structural example of this embodiment, a surface layer of the developing roller 41 is a rubber such as urethane (rubber), and surface roughness Rz is defined as 5 μm or less in an initial condition. The electrode member 42, the squeeze roller 43, the cleaning roller 44 and the cleaning blade 45 are constituted by stainless steel (SUS). Surface roughness Rz of each of the electrode member 42, the squeeze roller 43 and the cleaning roller 44 is defined as a 1 μm or less.

[Developing Liquid]

Next, the developing liquid used in this embodiment will be described. The toner particles are those in which colorant particles are incorporated in a binder resin material, and as the binder resin material, for example, it is possible to cite polyester resin material, epoxy resin material, styrene-acrylic resin material and the like. As the colorant particles used in the toner particles, it is possible to use general-purpose organic or inorganic pigments. Content of a colorant in the toner particles may preferably be 5 wt. parts or more and 100 wt. parts or less per 100 wt. parts of the binder resin material.

As a pigment for black, carbon black can be cited. Further, as pigments assuming blue or cyan, it is possible to cite the following pigments: C.I. Pigment Blue 2, 3, 15:2, 15::3, 15:4, 16, 17; C.I. Bat Blue 6; C.I. Acid Blue 45, and a copper phthalocyanine pigment having a phthalocyanine skeleton replaced by one to five phthalimidemethyl groups.

The toner particles may preferably contain a pigment dispersant. As a dispersing assistant, synergists corresponding to various pigments are also capable of being used. Contents of preferred pigment dispersant and preferred pigment dispersing assistant are 0.01 to 50 wt. % in the toner particles. As the pigment dispersant, a known pigment dispersant can be used, and for example, as the dispersant, it is possible to cite hydroxyl group-containing carboxylate, a salt of long-chain polyaminoamide and a polymeric acid ester, a salt of a polycarboxylic acid, a polymeric unsaturated acid ester, a copolymer, a modified polyacrylate, an aliphatic polycarboxylic acid, a naphthalene sulfonic acid formalin condensate, a polyoxyethylene alkyl phosphate, a pigment derivative, and the like. Further, it is possible to cite a commercially available polymeric dispersant such as "Solsperse series", manufactured by Lubrizol Corp.

An energy curable liquid used as the carrier liquid may preferably contain a charge control agent for imparting electric charges to the toner particle surfaces, a photo-polymerization initiator for generating acid by ultraviolet (UV) irradiation and a monomer bondable by the acid. The monomer bondable by the acid may preferably be a vinyl ether compound which is polymerizable by a cationic polymerization reaction.

Separately from the photo-polymerization initiator, the energy curable liquid may further contain a sensitizer. Further, in order to suppress a lowering in storage property by photo-polymerization, it is preferable that a cationic polymerization inhibitor may preferably be contained in an amount of 10-5000 ppm on a weight basis of the energy curable liquid. In addition, a charge control aid, another additive or the like may also be contained in the energy curable liquid.

The monomer (cationic polymerizable monomer), UV curing agent contained in the energy curable liquid is a mixture of a monofunctional monomer having one vinyl either group (represented by the following chemical formula (Chem 1)) and a difunctional monomer having two vinyl ether groups (represented by the following chemical formula (Chem 2)).

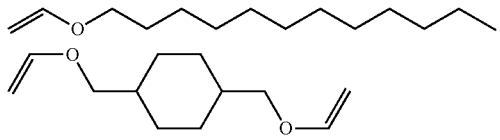

The photo-polymerization initiator contained in the energy curable liquid is a compound represented by the following chemical formula (Chem 3) as a general formula. In the chemical formula (Chem 3), R1 and R2 connect with each other and form a ring structure. Further, x represents an integer of 1-8, and y represents an integer of 3-17.

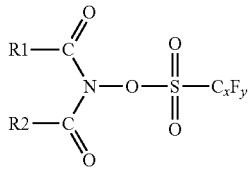

As the above-described ring structure, it is possible to exemplify a five-membered ring or a six-membered ring. Specifically, for example, it is possible cite a succinimide structure, a phthalimide structure, a norbornene dicarboxylimide structure, a naphthalene decarboxyimide structure, a cyclohexane dicarboxyimide structure, an epoxycyclohexene dicarboxyimide structure, and the like. Further, these ring structures may also include, as substituents, alkyl groups of 1-4 in carbon number, alkyloxy groups of 1-4 in carbon number, alkylthio groups of 1-4 in carbon number, aryl groups of 6-10 in carbon number, aryloxy groups of 6-10 in carbon number, arylthio groups of 6-10 in carbon number, and the like groups.

As $C_xF_y$ in the chemical formula (Chem 3), it is possible to cite a linear alkyl group (RF1), a branched-chain alkyl group (RF2), a cycloalkyl group (RF3) and an aryl group (RF4), in which hydrogen atom is replaced with fluorine atom.

As the linear alkyl group (RF1) in which hydrogen atom is replaced with fluorine atom, for example, it is possible to cite a trifluoromethyl group (x=1, y=3), a pentafluoroethyl group (x=2, y=5), a nonafluorobutyl group (x=4, y=9), a perfluorohexyl group (x=6, y=13) and perfluoroactyl group (x=8, y=17), and the like group.

As the branched-chain alkyl group (RF2) in which hydrogen atom is replaced with fluorine atom, for example, it is possible to cite a perfluoroisopropyl group (x=3, y=7), a perfluoro-tert-butyl group (x=4, y=9), a perfluoro-2-ethylhexyl group (x=8, y=17), and the like group.

As the cycloalkyl group (RF3) in which hydrogen atom is replaced with fluorine atom, for example, it is possible to cite a perfluorocyclobutyl group (x=4, y=7), a perfluorocyclopentyl group (x=5, y=9), a perfluorocyclohexyl group (x=6, y=11), a perfluoro(1-cyclohexyl)methyl group (x=7, y=13), and the like group.

As the aryl group (RF4) in which hydrogen atom is replaced with fluorine atom, for example, it is possible to cite a pentafluorophenyl group (x=6, y=5), a 3-trifluoromethyltetrafluorophenyl group (x=7, y=7), and the like group.

The content of the photo-polymerization initiator is not particularly limited, but may preferably be 0.01-5 wt. parts per 100 wt. parts of the cationic polymerizable monomer (preferably a vinyl ether compound). In the structural example of this embodiment, a compound represented by the following chemical formula (Chem 4) is contained in an amount of 0.3 wt. % per a total weight of the above-described monomer (cationic polymerizable monomer, UV-curable agent). By using this photo-polymerization initiator, different from the case where an ionic photo-acid generator is used, a high-resistance liquid recording liquid can be obtained while enabling satisfactory fixing.

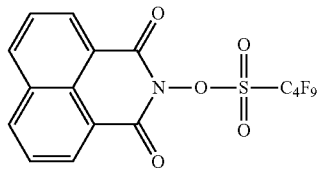

The above-described cationic polymerizable monomer may desirably be at least one kind of a compound selected from the group consisting of dodecyl vinyl either, dipropylene glycol divinyl ether, dicyclopendadiene vinyl ether, cyclohexanedimethanol divinyl ether, tricyclodecane vinyl ether, trimethylolpropane trivinyl ether, 2-ethyl-1,3-hexamediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

Figure 3:
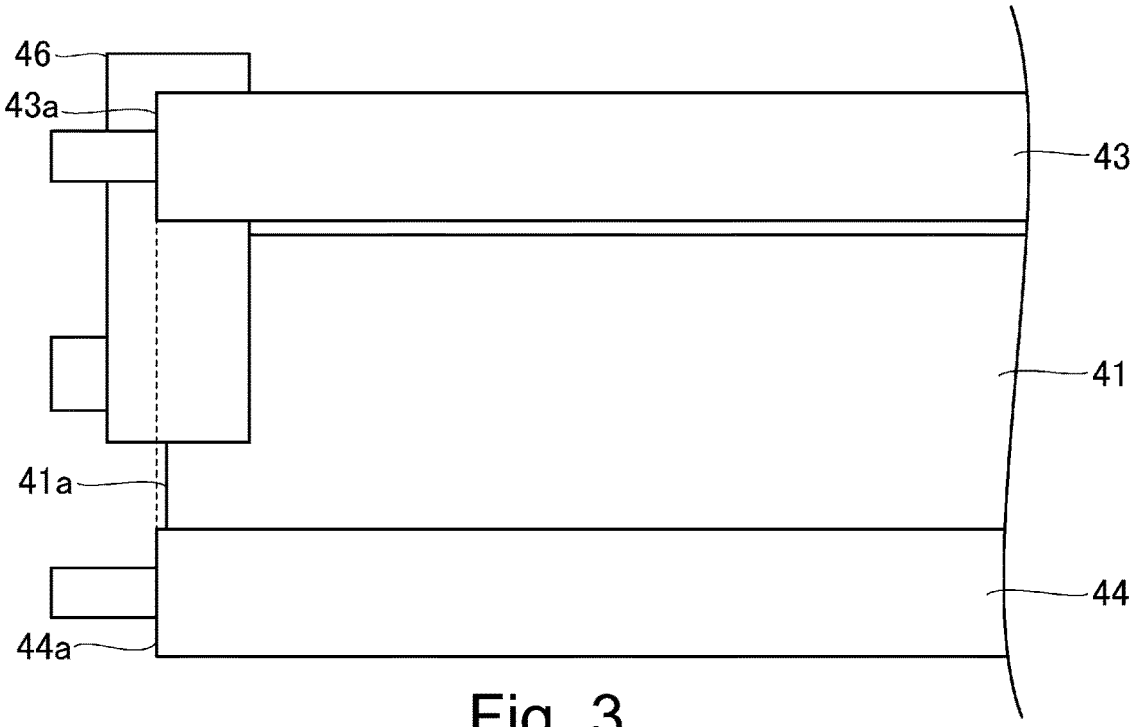
FIG. 3 is a schematic view showing a structure of a neighborhood of an end portion of a developing roller with respect to a longitudinal direction.

Next, using FIG. 3, a structure of the developing device 4 with respect to a longitudinal direction, i.e., a widthwise direction perpendicular to a rotational direction of the developing roller 41 will be described. FIG. 3 is a schematic view showing a positional relationship among one end portions 41*a*, 43*a* and 44*a* of the developing roller 41, the squeeze roller 43 and the cleaning roller 44 with respect to the longitudinal direction, and other end portions are also constituted symmetrically with this positional relationship. Further, in the following description, a "length" refers to a length in the above-described longitudinal direction unless otherwise specified.

In this embodiment, an image formable region, i.e., a maximum width of an image capable of being formed on the recording material P is 340 mm. On the other hand, a length of the developing roller 41 is 350 mm, and lengths of the squeeze roller 43, the cleaning roller 44 and the electrode member 42 are 356 mm. These members (41-44) are disposed so that center positions with respect to the longitudinal direction are aligned with each other. A length (length in the axial direction) of the photosensitive drum is 390 mm, and opposes an entire region of an outer peripheral surface of the developing roller 41 with respect to the longitudinal direction. The cleaning blade 51 (see FIG. 2) for cleaning the photosensitive drum is 380 mm in length, and covers an entirety of a region in which the developing liquid is deposited from the developing roller 41 on the photosensitive drum 1. Further, a width of the intermediary transfer belt 11 (see FIG. 1) is 365 mm, and is set so as to be shorter than the length of the photosensitive drum 1 in the axial direction. Further, the length of the secondary transfer roller 13 in the axial direction is 360 mm.

In a constitution in which compared with the developing roller 41, the squeeze roller 43 and the cleaning roller 44 are equal or shorter in length, at an end portion of the developing roller 41, a region where a liquid amount of the developing liquid is not regulated occurs. That is, there is a possibility that liquid cross-linking of the developing liquid occurs between the outer peripheral surface of the developing roller 41 and the end portions 43*a* and 44*a* of these members, and a region where the developing liquid is excessively deposited occurs in the neighborhood of the end portion of the developing roller 41 with respect to the longitudinal direction and leads to an image defect such as a stripe image. For this reason, in this embodiment, a constitution in which compared with the developing roller 41, the squeeze roller 43 and the cleaning roller 44 are long is employed.

Further, the electrode member 42 is equal in length to the squeeze roller 43 and the cleaning roller 44, but may also have a constitution in which the length thereof is short compared with the length of these rollers. However, in the following description, a liquid cross-linking phenomenon between the developing roller 41 and the end portion seal is capable of occurring even in the case where the electrode member 42 is short. That is because the developing liquid which passes through a gap between the electrode member 42 and the developing roller 41 and which enters a nip of the squeeze roller 43 is extended in the longitudinal direction when a thickness of the developing liquid is regulated by the squeeze roller 43. In this embodiment, a gap (electrode gap) between the electrode member 42 and the developing roller 41 is about 500 μm, the developing liquid after passing through the squeeze roller 43 is regulated to a thickness of about 4 μm or less. For this reason, if the electrode member 42 is shortened, the developing liquid in a large amount extends toward the end portion with respect to the longitudinal direction due to a difference between a width of the above-described electrode gap and a regulation thickness by the squeeze roller 43.

Further, it is preferable that the developing roller 41 is short (in length) compared with the photosensitive drum 1. This is because in general, the photosensitive layer exposes on an end surface of the photosensitive drum 1 with respect to the axial direction and there is a possibility that current leakage occurs between the developing roller 41 and the photosensitive drum and has the influence on a development result.

Here, at end portions of the developing roller 41 on opposite sides with respect to the longitudinal direction, end portion seals 46 are provided. The end portion seals 46 restrict movement of the developing liquid to an outside than a carrying surface of the developing roller 41 with respect to the longitudinal direction. However, the carrying surface of the developing roller 41 is a region where of an outer peripheral surface 41*b*, the developing liquid reaches the developing portion Gd in a state in which the developing liquid is carried by the developing roller 41, and in this embodiment, an entire region of the outer peripheral surface 41*b* in the longitudinal direction corresponds to the carrying surface.

Figure 4:
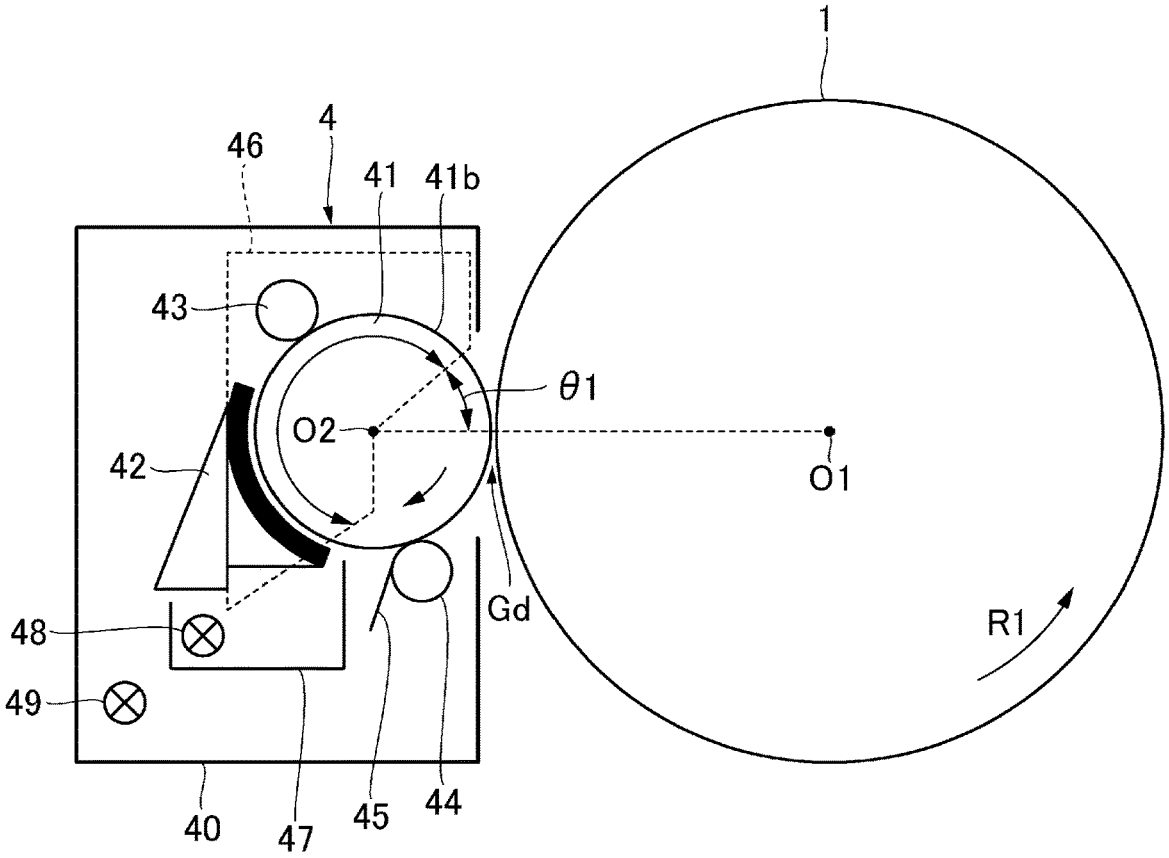
FIG. 4 is a schematic view showing a positional relationship between an end portion seal and other members.

As shown in FIG. 4, a range in which the end portion seal 46 covers the developing roller 41 extends from a position where the end portion seal 46 overlaps with the electrode member 42 with respect to the rotational direction of the developing roller 41 to a position downstream of the squeeze roller 43 after passing through the nip of the squeeze roller 43. By this, the end portion seal 46 restricts deposition of the developing liquid, stored in the supply tray 47, on the end portion of the developing roller 41. Further, the end portion seal 46 restricts deposition of the developing liquid, squeezed by the squeeze roller 43, on the end portion of the developing roller 41.

In order to suppress movement of the developing liquid after the surface of the developing roller 41 is separated from the end portion seal 46, the end portion seal 46 may desirably extend to a position close to the developing portion Gd with respect to the rotational direction of the developing roller 41 to the extent possible. In the structural example of this embodiment, in consideration of an assembling tolerance or the like between the end portion seal 46 and the photosensitive drum 1, an angle θ1 between an end portion of the end portion seal 46 and the developing portion Gd with respect to the rotational direction of the developing roller 41 was about 40°. That is, an angle of rotation from an end portion position of the end portion seal 46 on a position of the outer peripheral surface 41*b* of the developing roller 41 to a rectilinear line connecting rotational axes O1 and O2 of the developing roller 41 and the photosensitive drum 1 is about 40°.

[End Portion Fog Image]

Figure 5:
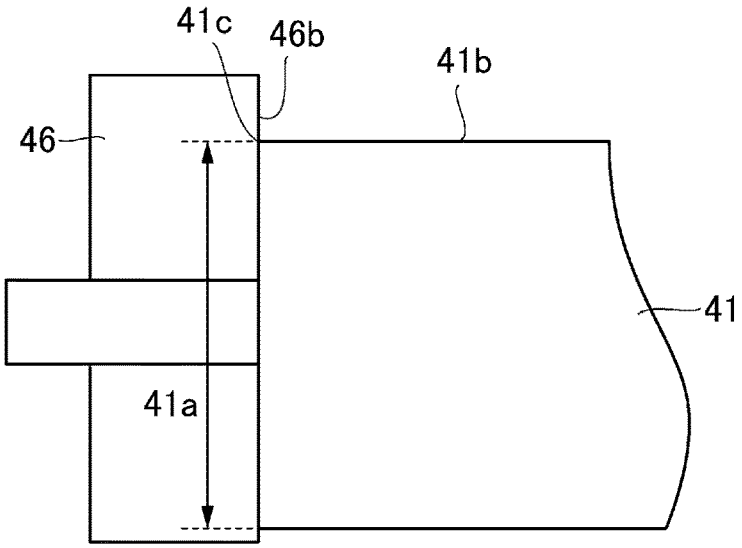
FIG. 5 is a schematic view showing the end portion seal and the developing roller.

Here, an occurrence of a fog image, depending on a structure of the end portion seal 46, at a position corresponding to the end portion of the developing roller 41 will be described. As shown in FIG. 5, the end portion seal 46 has a restricting surface 46*b* contacting the end portion 41*a* of the developing roller 41. The restricting surface 46*b* contacts an edge portion 41*c* of the outer peripheral surface 41*b* of the developing roller 41 with respect to the longitudinal direction and extends substantially perpendicular to the axis of the developing roller 41 toward an outside than the outer peripheral surface 41*b* with respect to a radial direction. By this, the developing liquid carried on the outer peripheral surface 41*b* which is the carrying surface is restricted in that the developing liquid reaches the end portion 41*a* of the developing roller 41 by moving around the edge portion 41*c* in a range in which at least the restricting surface 46*b* is disposed.

Figure 6:
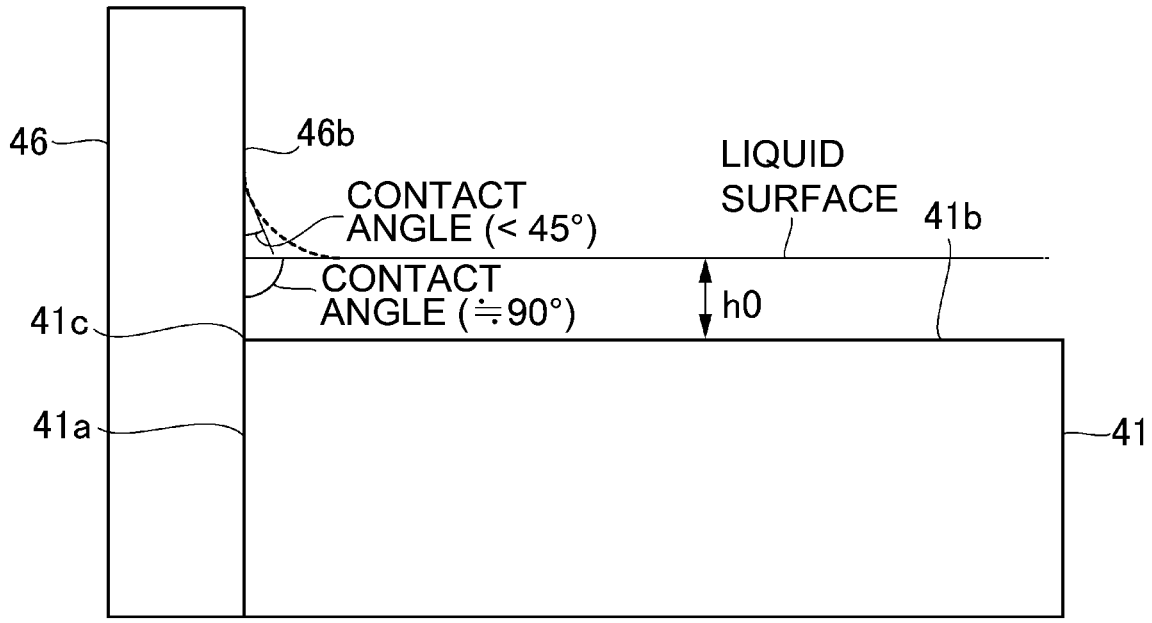
FIG. 6 is a schematic view for illustrating liquid cross-linking formed between the end portion seal and the developing roller.

As shown in FIG. 6, when a thickness of the developing liquid is regulated by the squeeze roller, the outer peripheral surface 41*b* of the developing roller 41 is in a state in which the outer peripheral surface 41*b* is coated with the developing liquid having a liquid surface with a certain height h0. With this, in the neighborhood of the edge portion 41*c* of the developing roller 41, the developing liquid is in a state in which the developing liquid contacts the restricting surface 46*b* of the end portion seal 46. At this time, with higher wettability of the restricting surface 46*b* to a state such that the developing liquid runs up onto the restricting surface 46*b* toward a direction of being moved away from the outer peripheral surface 41*b* of the developing roller 41 is formed (see broken line). That is, liquid cross-linking by the developing liquid occurs between the restricting surface 46*b* of the end portion seal 46 and the outer peripheral surface 41*b* of the developing roller 41, so that a state in which the developing liquid accumulates in the neighborhood of the edge portion 41*c* is formed in some instances.

When the developing roller 41 is rotated in the state in which such liquid cross-linking occurs, the developing liquid in a large amount deposits in the neighborhood of the edge portion 41*c* during separation of the outer peripheral surface 41*b* of the developing roller 41 from the restricting surface 46*b*. That is, a part of the developing liquid which has formed the liquid cross-linking moves to the developing roller 41, whereby the developing liquid in a large amount compared with the liquid amount with a height h0 of the developing liquid regulated by the squeeze roller deposits. In this state, when the outer peripheral surface 41*b* of the developing roller 41 reaches the developing portion Gd, a part of the toner particles deposits on the photosensitive drum irrespective of the surface potential of the photosensitive drum, so that thin image (so-called fog image) is to be formed in a region (white background portion) where the image should be formed.

Specifically, in the structural example of the above-described embodiment, the dark-portion potential of the photosensitive drum was −600 [V], and the bias voltage applied to the developing roller was −400 [V]. In this case, on the toner particles in a position corresponding to the white background portion in the developing portion, an electrostatic bias (fog-removing bias) in a direction toward the developing roller acts with electric field intensity equivalent to application of a DC voltage of 200 [V] to the developing roller on the basis of the surface potential of the photosensitive drum. By this, electric field separation is carried out so that the toner particles contained in the developing liquid are pressed against the developing roller, so that deposition of the toner particles on the white background portion is prevented. However, when the developing liquid in an amount in which the developing liquid cannot be completely electrolyzed by the fog-removing bias due to the liquid cross-linking enters the developing portion, the surface of the photosensitive drum passes through and comes out of the developing portion Gd in a state in which a part of the toner particles deposits on the photosensitive drum, so that a fog image generates. Further, such a fog image tends to be conspicuous in the case where a state in which the developing roller and the photosensitive drum contact the developing liquid for a long time continues.

[Contact Angle]

Figure 7:
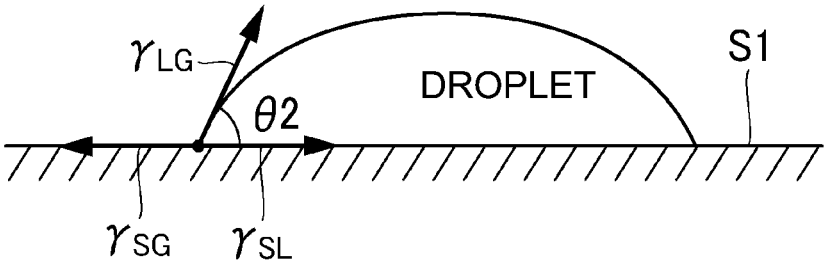
FIG. 7 is a schematic view for illustrating a definition of a contact angle.

Therefore, in this embodiment, by controlling a contact angle of the developing liquid to the restricting surface of the end portion seal, reduction of occurrence of the liquid cross-linking and of the fog image is realized. The contact angle is defined by an angle formed, when a solid surface contacts a liquid and gas, by a liquid surface with the solid surface in a boundary line where the three phases contact each other. That is, as shown in FIG. 7, an angle θ formed between the liquid surface and a solid surface S1 in an end portion of a droplet deposited on the solid surface S1 is contact angle.

As shown in FIG. 6, the contact angle of the developing liquid to the restricting surface 46*b* of the end portion seal 46 is a magnitude of an angle formed between the restricting surface 46*b* and the liquid surface of the developing liquid contacting the restricting surface 46*b* as seen from a direction (a direction of tangential line of the outer peripheral surface 41*b* of the developing roller 41) parallel to the restricting surface 46*b*. In FIG. 6, the case where the contact angle of the developing liquid to the restricting surface 46*b* is less than 45° (broken line) and the case where the contact angle is about 90° (solid line) are shown.

The contact angle of the developing liquid to the member constituting the end portion seal 46 was acquired by the following measuring method. For measurement, a contact angle meter PCA-11 manufactured by Kyowa Interface Science Co., Ltd. is used. In measurement with the contact angle meter PCA-11, a droplet image acquired from a mounted camera is subjected to image analysis by an image analyzing software FAMAS (manufactured by Kyowa Interface Science Co., Ltd.) corresponding to the above-described PCA-11, so that the contact angle at 1 sec of contact is calculated through image processing.

For the measurement of the contact angle, the developing liquid in the mixer was used. A droplet of 1.0 uL (in volume) was formed by injecting the droplet of the developing liquid through an injection needle of 1.0 mm in injection diameter. This is contacted to an object-to-be-measured, and by the above-described image analyzing software, the contact angle at 1 sec of contact was calculated. A measuring operation was performed at room temperature. Incidentally, it has been known that an inner temperature of the developing container in the case where the image forming apparatus of this embodiment carries out the image forming operation is the same as the room temperature and is roughly in a range of 25° C.-35° C.

Incidentally, a TD ratio of the developing liquid used in the measurement, i.e., a weight ratio of a toner component to an entire component of the developing liquid is 3.5%. Further, the carrier liquid of the developing liquid used in the measurement comprises only dodecyl vinyl either as a component. The present inventors have confirmed that even the above-described developing liquid containing the photopolymerization initiator or the like, even only the carrier liquid excluding the toner, or even dodecyl vinyl either contained in the carrier liquid shows the substantially same contact angle. For this reason, the developing liquid having the above-described component is used in the following measurement, but a similar result is obtained even when the developing liquid is replaced with these liquids. That is, by determining a constitution of the end portion seal with use of a result of the measurement of a main component of the carrier liquid of the developing liquid, an actual contact angle in the inside of the apparatus can be controlled.

In this embodiment, as a material of the end portion seal 46 one which is an elastic member comprising polyethylene or polyurethane and which is a fluorocarbon resin material or one which is an elastic liquid comprising polyethylene or polyurethane and which is coated with the fluorocarbon resin material at a surface thereof is used. In general, a fluorine-treated member is low in surface energy and thus exhibits a lipophobic property, and therefore, is a suitable material in the case where the lipophobic property is intended to be controlled in the case where the carrier liquid comprising oil-based (hydrophobic) molecules as in this embodiment. As regards a shape, a flat plate-like rubber or a foam sponge is suitable. However, in the case where the foam sponge is used, a foam structure thereof may preferably comprise a closed-cell which does not permit passage of the liquid.

Hardness of the end portion seal 46 may preferably be in a range of 40° or more and 60° or less in terms of Asker-C, and is 50°, for example. A lower limit of the hardness is determined in consideration of an entering (penetration) amount described later. Further, there is a possibility of breakage due to settling in the case where the hardness is low, and there is a possibility of deterioration and breakage or the like of a developing roller end portion due to wearing in the case where the hardness is high, and therefore, a preferred range of the hardness is set in consideration of such factors and the material of the developing roller.

As regards surface roughness of the end portion seal 46, it is desirable that surface roughness Rz is 20 μm or less in the case where the end portion seal 46 is the flat plate-like rubber, and a cell diameter is 200 μm or less in the case where the end portion seal 46 is the foam sponge. This is because in the case where the roughness is excessively large, the developing liquid is trapped by the surface of the end portion seal 46 and irrespective of occurrence or non-occurrence of the liquid cross-linking, the developing liquid in an amount in which the developing liquid cannot be separated by the electric field is supplied to the developing roller with rotational drive of the developing roller in some instances.

The entering amount of the end portion seal 46 into the developing roller 41 is, for example, 0.7 mm. However, the entering amount refers to a displacement amount of the restricting surface 46*b* with respect to the longitudinal direction, by pressing-in of the restricting surface 46*b* in contact with the developing roller 41, relative to a position of the restricting surface 46*b* of the end portion seal 46 in a state in which elastic deformation does not occur. In order to restrict entrance of the developing liquid into the end portion 41*a* of the developing roller 41, the entering amount of a certain level or more is needed, and when the entering amount is excessively small, an amount of the developing liquid carried by the end portion 41*a* increases with rotation of the developing roller 41, so that there is a possibility that the developing liquid causing the fog image is supplied to the developing roller. On the other hand, when the entering amount is excessively large, the amount of the developing liquid carried by the end portion 41*a* can be decreased, but friction generating between the end portion 41*a* of the developing roller and the end portion seal 46 increases. In this case, there is a possibility that inclusion of a foreign matter into the developing liquid and destability of a driving speed of the developing roller 41 due to deterioration and breakage of the end portion 41*b* of the developing roller 41 and the end portion seal 46 are invited. In consideration of these factors, the entering amount is suitable when being set in a range of about 0.7±0.4 mm.

Incidentally, a constitution such as preferred material, arrangement and the like of the end portion seal 46 described above is suitable when being employed for at least the restricting surface 46*b* of the end portion seal 46 and for at least between the squeeze roller 43 and the developing portion Gd (see FIG. 4). By this, it is possible to expect that generation of the liquid cross-linking between the restricting surface 46*b* and the outer peripheral surface 41*b* of the developing roller 41 and of the fog image is efficiently reduced. For example, of the restricting surface 46*b*, only a side downstream of the squeeze roller 43 with respect to the rotational direction of the developing roller 41 may also be coated with a fluorocarbon resin material.

In the structural example of this embodiment, the end portion seal 46 is a foam sponge containing the fluorocarbon resin material and is 100-200 μm or less in cell diameter. Further, in the above-described contact angle meter, the droplet of 0.1 uL used in the measurement has a size of about 2.5 mm in diameter and has a size which is about 10 times or more the cell diameter. By this, even when there is a surface roughness of the end portion seal 46 due to the foam structure, it becomes possible to measure the contact angle macroscopically substantially equivalent to a measurement result for a solid member with no foam structure, so that measurement accuracy is ensured.

Next, the developing roller will be described. The developing roller in the structural example of this embodiment comprises a core shaft of stainless steel (SUS) with a diameter of 40 mm, and an outer periphery of the core shaft is covered with an elastic layer comprising polyethylene or polyurethane of 5 mm in thickness. Further, a surface layer of the elastic layer has been subjected to fluorine treatment and has a characteristic such that the surface layer repels water and oil.

The hardness of the developing roller is 25° or more and 50° or less in terms of Asker-C. Upper and lower limits of the hardness of the developing roller are set principally in consideration of efficiency of a developing process. That is, the upper and lower limits the developing roller hardness are set so that a sufficient width nip is formed between the developing roller and the photosensitive drum 1 in the developing portion Gd (see FIG. 4) and thus the electric field separation is sufficiently carried out in the developing portion Gd, i.e., so that the toner in the developing liquid electrophoretically moves depending on the surface potential of the photosensitive drum 1 before the toner passes through and comes out of the nip.

As regards the surface roughness of the developing roller, the surface roughness Rz may desirably be 5 μm or less in the case where the developing roller is the flat plate-like rubber. Also as regards the roughness, similarly, roughness in which satisfactory development is enabled principally in the development nip is selected.

Further, in the above-described structural example, as regards the contact angle of the developing liquid to the outer peripheral surface of the predetermined, the contact angle for the dodecyl vinyl either was 15°. In general, the contact angle of the developing liquid to the developing roller may preferably be small. This is because when the developing roller is in a state in which the contact angle is large, i.e., in a state in which the developing roller is higher in surface energy than the developing liquid, the surface of the developing roller repels the developing liquid. In this case, after the outer peripheral surface of the developing roller passes through the electrode gap and the nip of the squeeze roller, the outer peripheral surface of the developing roller does not readily hold the layer of the developing liquid, so that there is a possibility that a distribution of a so-called (toner) application amount becomes unstable such that coating with the developing liquid is lost in a part of a region.

Next, the squeeze roller will be described. The squeeze roller is constituted by, for example, a cylindrical stainless steel (SUS) of 15 mm in diameter. The surface roughness Rz of the squeeze roller may desirably be 0.1 μm or less. By setting such a roughness, in a constitution in which the developer containing, as a component, the toner particles of 0.1 μm or less in average particle size are used, satisfactory development is enabled.

An entering amount of the end portion seal 46 into the squeeze roller may preferably be, for example, 0.7 mm. The squeeze roller is a smooth metal, and there a possibility of slip-through of the liquid developer due to settling, deterioration and the like of the end portion seal is small even when the end portion seal strongly contacts the squeeze roller and the influence of the squeeze roller on a rotation load is small, and therefore, the entering amount may also be 0.7 mm or more.

Further, as regards the contact angle of the squeeze roller to the developing liquid, it is desirable that the contact angle is equal to or larger than the contact angle of the developing roller and is smaller than the contact angle of the end portion seal. In the structural example of this embodiment, the contact angle of the squeeze roller to the dodecyl vinyl either is 10°.

[Contact Angles Between Developing Liquid and Developing Roller and Between Developing Liquid and End Portion Seal]

Here, the case where if the contact angle between the developing liquid and the developing roller is large compared with the contact angle between the developing liquid and the end portion seal will be described. In this case, surface energy of an interface between the developing roller and the developing liquid is lower than surface energy of an interface between the end portion seal and the developing liquid, so that the developing liquid is stabilized when the developing liquid contacts the end portion seal. As a result, the developing liquid extends on the restricting surface, and the liquid cross-linking is liable to be formed between the outer peripheral surface of the developing roller and the restricting surface of the end portion seal, so that the fog image generates in a position corresponding to the end portion of the developing roller. In order to reduce the fog image, reduction in amount of the developing liquid held in the neighborhood of the edge portion of the developing roller by such liquid cross-linking is effective. Here, the restricting surface is a side surface on the developing liquid side where the end portion seal is supported by the developing roller.

Figure 8:
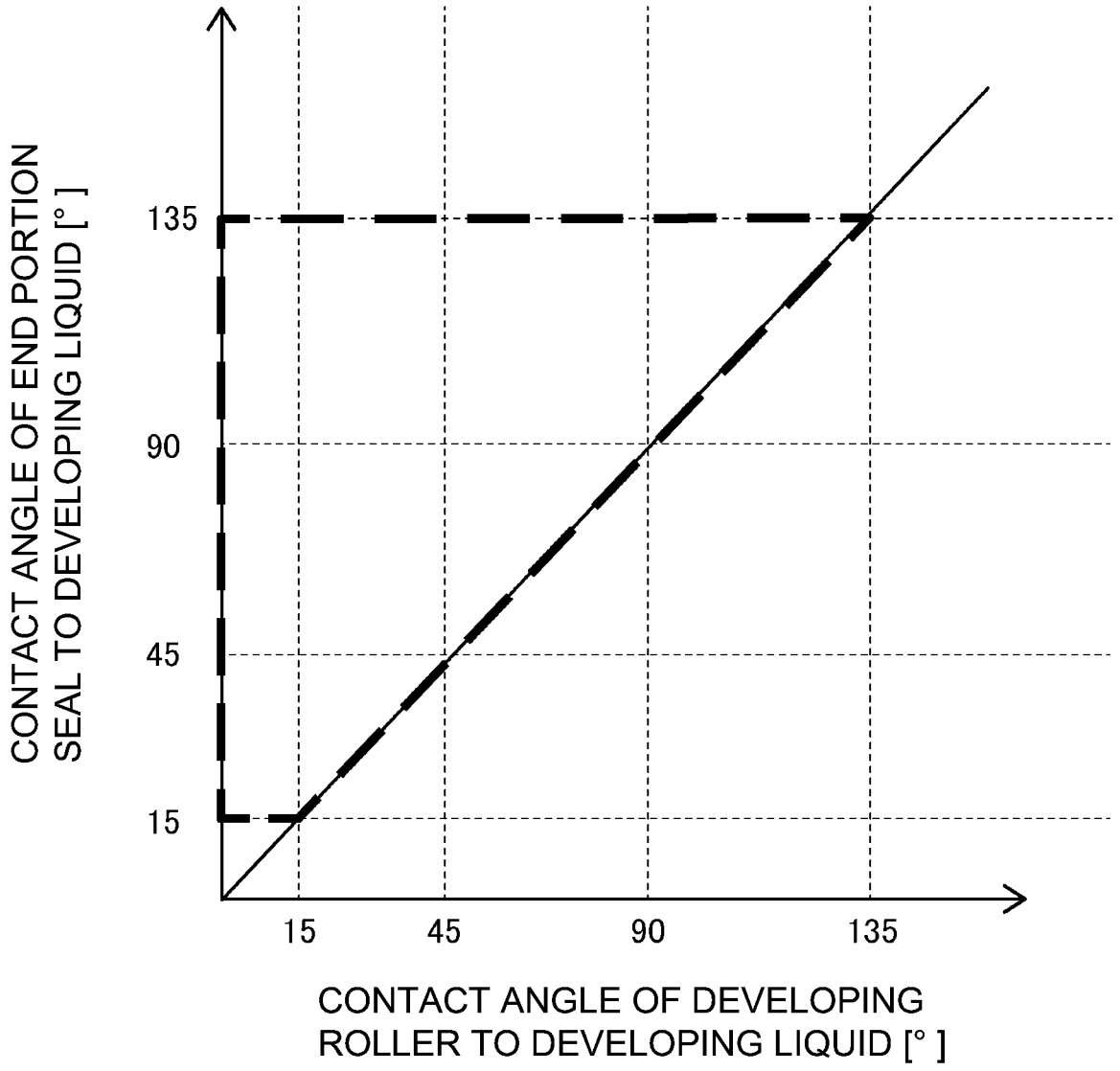
FIG. 8 is a graph showing a preferred range of contact angles of a developing liquid with the end portion seal and the developing roller.
Figure 9:
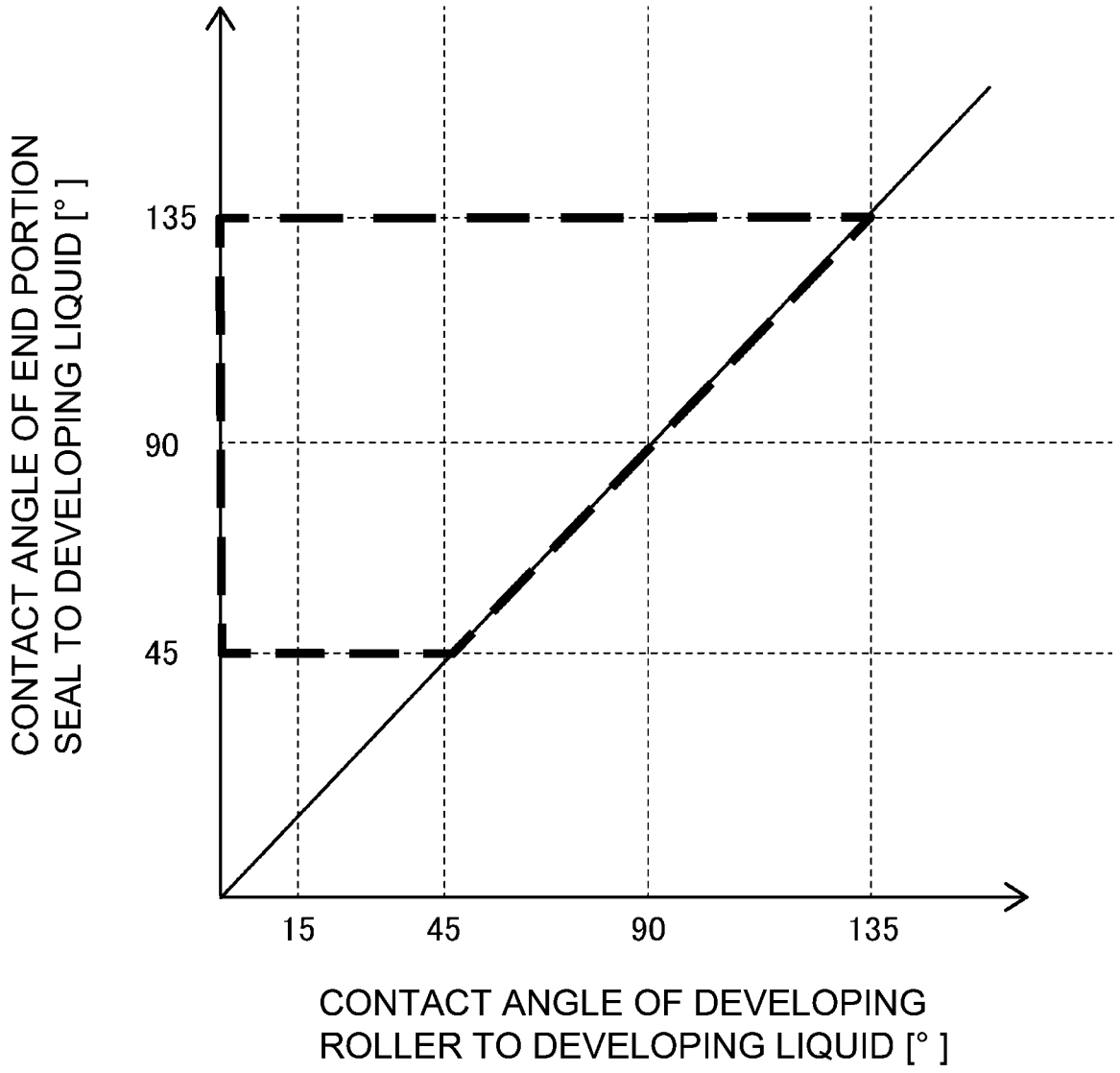
FIG. 9 is a graph showing a more preferred range of contact angles of the developing liquid with the end portion seal and the developing roller.
Figure 10:
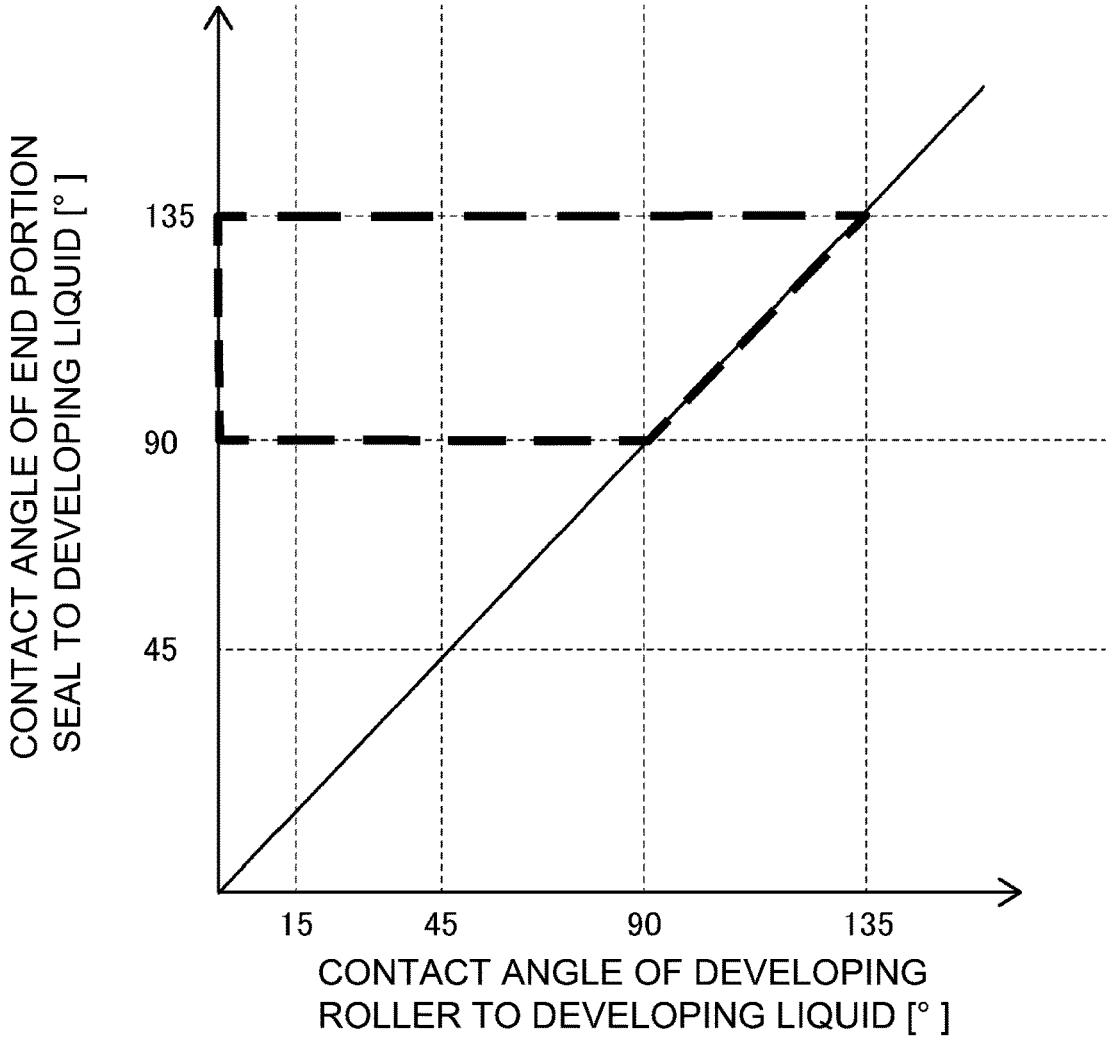
FIG. 10 is a graph showing a further preferred range of contact angles of the developing liquid with the end portion seal and the developing roller.

From the above, in this embodiment, the contact angle between the developing liquid and the end portion seal is constituted so as to be larger than the developing liquid and the developing roller. Preferred ranges of the contact angles (of the developing liquid) to the end portion seal and the developing roller are shown in FIG. 8 to FIG. 10. FIG. 8 shows an example of a preferred range of the contact angle, FIG. 9 shows a more preferred range, and FIG. 10 shows a further preferred range.

As shown in FIG. 8, the contact angle between the developing liquid and the end portion seal is regarded as being larger than the contact angle between the developing liquid and the developing roller (region on a side above a diagonal line). Further, when wettability of the end portion seal is very large (when the contact angle is small), the developing liquid is attracted to the end portion seal irrespective of the contact angle of the developing roller to the developing liquid, and therefore, the contact angle between the developing liquid and the end portion seal may preferably be 15° or more.

As shown in FIG. 9, the contact angle between the developing liquid and the end portion seal may more preferably be 45° or more. A basis therefor will be described using Young's formula. The Young's formula is the following formula (1) held by a balance of surface tension when the contact angle is θ, γLG is surface tension acting on liquid-gas interface, γSL is surface tension acting on liquid-solid interface, and γSG is surface tension acting on solid-gas interface (see FIG. 7).

$$\gamma SG=\gamma LG\times\cos\theta+\gamma SL \quad (1)$$

The surface tension γLG of the developing liquid in the structural example of this embodiment was 22 [mN/m] as an empirically acquired value. The contact angle θ at this time was 45°. Further, in an initial contact state, γSL was 14 [mN/m]. As a result of this, resultant γSG was about 30 [mN/m]. In actuality, the developing liquid is pulled downward by gravitation, but in the liquid with a height of about several μm, dominant force is not the gravitation, but is the surface tension.

Here, the case where the height of the developing liquid with respect to the outer peripheral surface of the developing roller, i.e., a thickness of the developing liquid regulated by the squeeze roller is 2.5 μm will be considered. In this case, in the neighborhood of the edge portion of the developing roller, depending on a magnitude of the contact angle θ to the end portion seal, the height of the developing liquid is a value different from 2.5 μm, so that the developing liquid becomes thicker with a smaller contact angle θ. It is assumed that the developing liquid carried in a range of 2.5 μm from the edge portion of the developing roller with respect to the longitudinal direction is substantially divided equally into portions on the end portion seal and the developing roller with rotation of the developing roller. Then, when the contact angle θ is 45°, the height of the developing liquid carried on the surface of the developing roller after the developing liquid is separated from the end portion seal is roughly 2.5 μm, so that the height of the developing liquid entering the developing portion becomes substantially uniform with respect to the longitudinal direction.

Accordingly, by making the contact angle between the end portion seal and the developing liquid 45° or more, uniformity of the height of the developing liquid entering the developing portion is enhanced, so that the fog image can be effectively reduced. Further, by making the contact angle 45° or more, a difference in wettability to the developing liquid becomes large between the developing roller, required that the contact angle to the developing liquid is small (for example 30° or less), and the end portion seal. By this, the developing liquid positioned in the neighborhood of the edge portion of the developing roller is separated stably from the end portion seal with the rotation of the developing roller and is carried on the developing roller, so that the developing liquid contributes to reduction in fog image.

As shown in FIG. 10, the contact angle between the developing liquid and the end portion seal is further preferably 90° or more. In the case where the contact angle is 90°, as shown as the solid line in FIG. 6, the liquid surface of the developing liquid is in a state in which the developing liquid surface contacts the restricting surface of the end portion seal 46 so as to be substantially perpendicular to the restricting surface 46*b*. That is, the developing liquid is repelled by the restricting surface 46*b* of the end portion seal 46, and therefore, the liquid cross-linking is not formed, so that the developing roller rotates in a state in which the height of the developing liquid is constant with respect to the longitudinal direction. Further, in the case where the contact angle is larger than 90°, a state in which a volume of the developing liquid carried in the neighborhood of the edge portion 41*c* is small compared with that at a central portion of the developing roller 41 with respect to the longitudinal direction. For this reason, generation of the fog image can be reduced more strongly.

On the other hand, as shown in FIG. 8 to FIG. 10 in common, the contact angle between the developing liquid and the end portion seal may preferably be 135° or less. This is because in the case where the contact angle is excessively large, there is a possibility that the developing liquid repelled from the restricting surface of the end portion seal drops and scatters into a periphery of the developing roller with the rotation of the developing roller and thus contaminates the photosensitive drum and the like.

The present inventors determined an upper limit of the contact angle by model calculation using Furmidge equation relating to dynamic contact angle. The Furmidge equation is represented by the following formula (1).

$$(mg \times \mathrm{Sin}\ \alpha)/\omega = \gamma LG(\cos \theta R - \cos \theta A) \quad (2)$$

However, m is the mass (weight) of the droplet, g is the acceleration of gravity [m/s$^2$], α is an angle of a slope along which the droplet descends [rad], ω is a width of the droplet [m], γLG is the surface tension of the droplet [mN/m], θR is a receding contact angle of the droplet [rad], and θA is an advancing contact angle of the droplet [rad].

Here, when the volume of one droplet of the developing liquid is 0.01 mL and specific gravity thereof 0.8 [g/cm$^3$], a weight thereof is 8 μg. Further, the angle α is 0 [rad] on assumption that the end portion seal is a perpendicular wall surface. As regards the width of the droplet, when the droplet is simply assumed as a sphere, a diameter is about 2.3 mm, and thus is considered as being corresponding to 4.6 mm which is twice thereof. γLG is an empirically acquired value and is 22 [mN/m]. Further, as regards (cos θR−cos θA) determined by θR and θA, it is assumed that the advancing contact angle and the receding contact angle assume the substantially same shape at a high contact angle of 90° or more, approximation of (cos θR−cos θA)=2 cos θA was made. Further, assuming that the advancing contact angle θA is substantially equal to a contact angle during rest, γLG acquired from the Furmidge equation becomes smaller than the empirical value of 22 [mN/m], i.e., the contact angle at which the surface tension is inferior to the gravitation is about 135°. Accordingly, in this embodiment, the upper limit of the contact angle was 135°.

According to study by the present inventors, it turned out that by such a constitution, the end portion fog image in the image forming apparatus is reduced. In the following table 1, a result of check of the presence or absence of the fog image in the case where a continuous image forming operation for continuously outputting images on a plurality of sheets was carried out in an image forming apparatus to which the constitution of this embodiment was applied. In respective cells (boxes) of the table 1, the result that the fog image was visible is x, and the result that the fog image was not recognized is 0. The respective columns in the table 1 represent elapsed times (immediately after a start to 5 hours) from a start of the continuous image forming operation, and the respective rows in the table 1 represent the contact angles each between the developing liquid and the end portion seal. The contact angle between the developing liquid and the developing roller is 15°. Further, a constitution in which during a period of the continuous image forming operation, the developing liquid is steadily supplied to the developing roller.

TABLE 1

| | | Time of endurance [h] | | | |
|---|---|---|---|---|---|
| | | 0 | 0.5 | 2 | 5 |
| Contact angle*1 [° C.] | 10 | x | x | x | x |
| | 25 | ○ | ○ | x | x |
| | 45 | ○ | ○ | ○ | x |
| | 90 | ○ | ○ | ○ | ○ |

*1"Contact angle" is the contact angle between the end portion seal and the developing liquid.

As shown in Table 1, in the case where the contact angle between the developing liquid and the end portion seal is 10°, i.e., in the case where the contact angle between the developing liquid and the end portion seal is an angle smaller than the contact angle (15°) between the developing liquid and the developing roller, the fog image generated immediately after the start of the image forming operation. In the case where the contact angle between the developing liquid and the end portion seal is 25° or more, the fog image was suppressed at least until 30 minutes elapsed from the start of the continuous image forming operation. However, in the case where the image forming operation was carried out continuously for 2 hours or more, the fog image generated. This would be considered because with a lapse of time, a range in which the developing liquid contacts the restricting surface of the end portion seal extends and the liquid cross-linking is formed, and the developing liquid in a large amount is intermittently deposited in the neighborhood of the edge portion of the developing roller.

On the other hand, the fog image was suppressed for 2 hours or more in the case where the contact angle between the developing liquid and the end portion seal is 45° and for 5 hours or more in the case where the contact angle is 90° or more. That is, it turned out that by setting the contact angle of the end portion seal to the developing liquid at 45° or more, preferably 90° or more, compared with the case where the contact angle of the end portion seal is simply larger than the contact angle of the developing roller, the fog image can be reduced even when the image forming apparatus is used continuously for a long time.

Thus, in the constitution of this embodiment, the end portion seal having a large contact angle to the developing liquid compared with the outer peripheral surface of the developing roller is used. In other words, the end portion restricting member having a large contact angle to the developing liquid compared with the carrying surface of the developer carrying member is used. By this, deposition of a large amount of the developing liquid on the periphery of the end portion of the carrying surface of the developer carrying member is prevented, so that generation of the fog image can be reduced with a simple constitution. Further, by appropriately setting the contact angle between the end portion restricting member and the developing liquid (see FIG. 9, FIG. 10), the generation of the fog image can be reduced in the image forming operation for the long time.

In this embodiment, as a method of adjusting the contact angle between the developing liquid and the restricting surface of the end portion seal, the end portion seal was constituted by the material having the lipophobic property, but the contact angle may also be adjusted by another method. For example, the contact angle may also be increased by forming minute unevenness on the restricting surface of the end portion seal. Further, such as in the case where the main component of the carrier liquid is polar molecules or in the like case, in the case where a different property from those exemplified in the above-described explanation is possessed, depending on this, the material of the end portion seal and the contents of the surface treatment, and the like may only be required to be changed.

Further, in this embodiment, description was made on the assumption that the end portion seal as the end portion restricting member contacts the opposite end portions of the developing roller with respect to the longitudinal direction, but a constitution in which the end portion seal contacts the outer peripheral surface of the developing roller on an inside (central side with respect to the longitudinal direction) than the edge portion of the developing roller may also be employed. Also in the case, a constitution in which the contact angle between the developing liquid and the end portion seal is large compared with the contact angle between the developing liquid and the developing roller may only be required to be employed. By this, not only movement of the developing liquid in the longitudinal direction is restricted by the end portion seal, but also the generation of the fog image due to the liquid cross-linking with the end portion seal and the carrying surface (region between itself and the end portion seal) of the developing roller can be reduced. However, as in this embodiment, by employing the constitution in which the end portion seal contacts the end portion of the developing roller, an entire region of the developing roller with respect to the longitudinal direction can be used for the development, so that the developing device can be constituted in a compact manner while ensuring an image size capable of image formation.

Second Embodiment

In the above-described embodiment, the constitution in which the end portion restricting member is provided in the developing device was employed. In this embodiment, an end portion seal 460 having a characteristic of the end portion seal 46 is attached to each of opposite end portions of the cleaning blade 51 for cleaning the photosensitive drum. Constitutions other than the cleaning blade 51 and the end portion seal 460 are similar to those in the above-described embodiment, and therefore will be omitted from description.

(Cleaning Blade)

Figure 11:
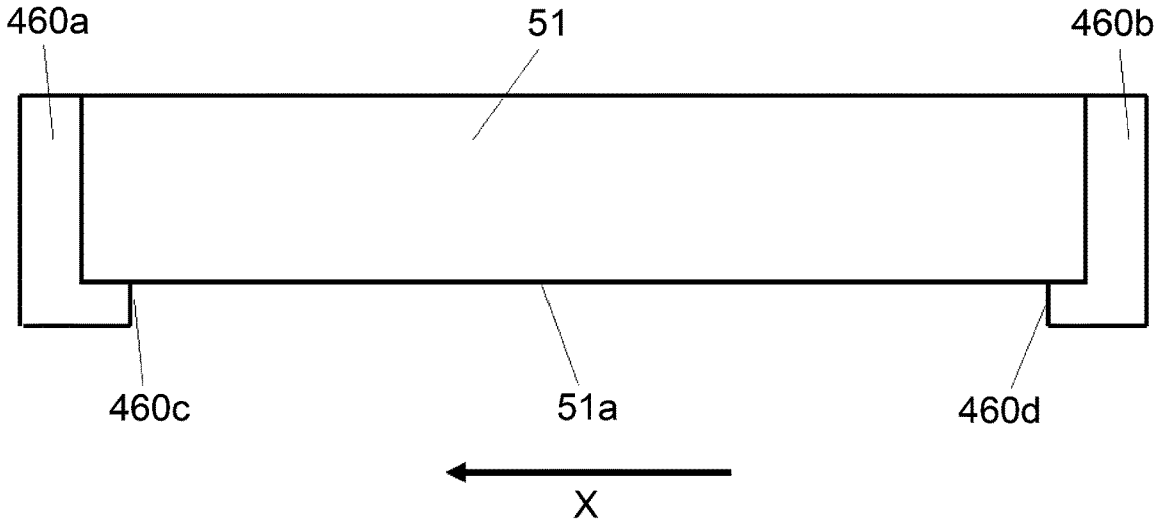
FIG. 11 is a view of a cleaning blade as seen from right above.

FIG. 11 is a view of the cleaning blade as seen from right above the cleaning blade. The cleaning blade contacts the photosensitive drum 1 at an edge portion 51*a* and removes the developing liquid on the photosensitive drum 1.

(End Portion Seal)

In this embodiment, as shown in FIG. 11, the end portion seal 460 is disposed in contact with the cleaning blade at each of opposite ends of the cleaning blade 51 with respect to a longitudinal direction X of the cleaning blade. Each end portion seal 460 has an L-shape so as to surround the end portion of the cleaning blade. The end portion seals 460 restrict the developing liquid by restricting surfaces 460*c* and 460*d*, respectively, so that the developing liquid removed by the edge portion 51*a* is not protruded from the cleaning blade. The restricting surfaces are side surfaces of the end portion seal positioned on a region side where the developing liquid on the cleaning blade is removed. Each of the restricting surfaces is positioned outside an image forming region with respect to the longitudinal direction X.

In this embodiment, as a material of the end portion seal 460 one which is an elastic member comprising polyethylene or polyurethane and which is a fluorocarbon resin material or one which is an elastic liquid comprising polyethylene or polyurethane and which is coated with the fluorocarbon resin material at a surface thereof is used. In general, a fluorine-treated member is low in surface energy and thus exhibits a lipophobic property, and therefore, is a suitable material in the case where the lipophobic property is intended to be controlled in the case where the carrier liquid comprising oil-based (hydrophobic) molecules as in this embodiment. As regards a shape, a flat plate-like rubber or a foam sponge is suitable. However, in the case where the foam sponge is used, a foam structure thereof may preferably comprise a closed-cell which does not permit passage of the liquid.

Hardness of the end portion seal 460 may preferably be in a range of 40° or more and 60° or less in terms of Asker-C, and is 50°, for example.

As regards surface roughness of the end portion seal 460, it is desirable that surface roughness Rz is 20 μm or less in the case where the end portion seal 460 is the flat plate-like rubber, and a cell diameter is 200 μm or less in the case where the end portion seal 460 is the foam sponge.

In the structural example of this embodiment, the end portion seal 460 is a foam sponge containing the fluorocarbon resin material and is 100-200 μm or less in cell diameter. Further, in the above-described contact angle meter, the droplet of 0.1 uL used in the measurement has a size of about 2.5 mm in diameter and has a size which is about 10 times or more the cell diameter. By this, even when there is a surface roughness of the end portion seal 460 due to the foam structure, it becomes possible to measure the contact angle macroscopically substantially equivalent to a measurement result for a solid member with no foam structure, so that measurement accuracy is ensured.

[Contact Angle Between Developing Liquid and End Portion Seal]

In this embodiment, in order to prevent the moving developing liquid removed by the edge portion 51*a* from leaking out to the outside along the edge portion 51*a*, the contact angle between the developing liquid and the restricting surface is set at 45° or more. By making the contact angle large, movement of the removed developing liquid around the restricting surfaces can be reduced. Incidentally, a measuring method of the contact angle is similar to that in the above-described embodiment. Further, this effect is more preferred when the contact angle is made 90° or more, and is further improved when the contact angle is made 135° or more.

Incidentally, in this embodiment, the contact angle between the restricting surface and the developing liquid is larger than the contact angle between the cleaning blade and the developing liquid. Here, the contact angle between the cleaning blade and the developing liquid is measured in the neighborhood (in a region within 10 mm from the edge portion) of the edge portion 51*a*.

In this embodiment, the constitution of the cleaning blade for cleaning the photosensitive drum 1 was employed, but the cleaning blade may also be a cleaning blade for cleaning an object in contact with the object. Further, in this embodiment, an elastic cleaning blade was used, but the material of the cleaning blade is not limited to this material. For example, in a constitution such that the developing liquid on a metal roller is removed in contact with the metal roller, a metal blade is used in some cases, and even when the end portion seal in this embodiment is also employed for this metal blade, a similar effect can be obtained In the above-described embodiments, the end portion seals provided for the developing roller and the cleaning blade were described. Even when the end portion seal in this embodiment is also used for the metal roller (holding roller)

for carrying the developing liquid, it is possible to reduce leakage, to the outside, of the developing liquid by movement around the metal roller.

Incidentally, the present invention is not limited to the above-described embodiment, but is of course applicable to other constitutions.

INDUSTRIAL APPLICABILITY

According to the present invention, there is provided the developing device capable of reducing movement of the developing liquid around the end portion with a simple constitution.

EXPLANATION OF SYMBOLS

1 . . . image bearing member (photosensitive drum)/ 4 . . . developing device/ 41 . . . developer carrying member (developing roller)/ 41*b* . . . carrying surface (outer peripheral surface)/ 43 . . . regulating member (squeeze roller)/ 46 . . . end portion restricting member (end portion seal)/ 46*b* . . . restricting surface/ 47 . . . supplying portion (supply tray)

The invention claimed is:

1. A developing device comprising:

a rotatable developer carrying member for carrying a liquid developer on a carrying surface for developing an electrostatic latent image borne on an image bearing member; and an end portion restricting member, provided in contact with said developer carrying member at an end portion of said developer carrying member with respect to a rotational axis direction of said developer carrying member, for restricting movement of the liquid developer in the rotational axis direction of said developer carrying member, wherein a contact angle of the liquid developer to a side surface of said end portion restricting member on a side where said developer carrying member carries the liquid developer is larger than a contact angle of the liquid developer to said carrying surface of said developer carrying member, and wherein the contact angle of the liquid developer to said side surface of said end portion restricting member is 45° or more.

2. A developing device according to claim 1, wherein the contact angle of the liquid developer to said side surface of said end portion restricting member is 90° or more.

3. A developing device according to claim 1, wherein the contact angle of the liquid developer to said side surface of said end portion restricting member is 135° or less.

4. A developing device according to claim 1, further comprising, a supplying portion for supplying the liquid developer to said developer carrying member, and a liquid amount regulating member, provided downstream of said supplying portion with respect to a rotational direction of said developer carrying member and upstream of a developing portion where said developer carrying member develops an electrostatic latent image borne on the image bearing member, for regulating an amount of the liquid developer which is carried on said developer carrying member.

5. A developing device according to claim 1, wherein said side surface of said end portion restricting member is an elastic member containing a fluorocarbon resin material.

6. A developing device according to claim 1, wherein a carrier liquid of the liquid developer contains dodecyl vinyl either, and a contact angle of the dodecyl vinyl either to said side surface of said end portion restricting member is larger than a contact angle of the dodecyl vinyl either to said carrying surface of said developer carrying member.

7. A developing device according to claim 1, wherein said side surface of said end portion restricting member is an elastic member surface-coated with the fluorocarbon resin material.

* * * * *